US005184121A

United States Patent [19]

Kogure et al.

[11] Patent Number: 5,184,121

[45] Date of Patent: Feb. 2, 1993

[54] FIELD SENSOR COMMUNICATION METHOD AND SYSTEM

[75] Inventors: Makoto Kogure; Akira Sase; Masao Fukunaga, all of Katsuta, Japan

[73] Assignee: Hitachi, Ltd., Tokyo, Japan

[21] Appl. No.: 487,124

[22] Filed: Mar. 2, 1990

[30] Foreign Application Priority Data

Mar. 3, 1989 [JP] Japan ..... 01-049837

[51] Int. Cl.[5] ..... G08C 19/16

[52] U.S. Cl. ..... 340/870.11; 340/870.18; 340/825.5; 340/310 R

[58] Field of Search ..... 340/870.11, 870.21, 340/825.51, 825.5, 310 R, 870.18, 870.39; 370/85.2, 85.3

[56] References Cited

U.S. PATENT DOCUMENTS

| | | | |
|---|---|---|---|
| 4,332,027 | 5/1982 | Malcolm et al. | 370/85.3 |
| 4,471,481 | 9/1984 | Shaw et al. | 340/825.5 |
| 4,516,122 | 5/1985 | Tomikowa | 340/825.5 |
| 4,598,285 | 7/1986 | Hoshen | 340/825.51 |
| 4,737,787 | 4/1988 | Ito et al. | 340/870.18 |
| 4,901,348 | 2/1990 | Nichols et al. | 340/825.5 |

FOREIGN PATENT DOCUMENTS

| | | |
|---|---|---|
| 58-48198 | 3/1983 | Japan . |
| 59-201535 | 11/1984 | Japan . |

*Primary Examiner*—Donald J. Yusko
*Assistant Examiner*—Michael Horabik
*Attorney, Agent, or Firm*—Antonelli, Terry, Stout & Kraus

[57] ABSTRACT

In a communication system in which a plurality of communication units are connected to a common two-wire transmission line and signal transmission/reception is made between the communication unit and a field sensor connected to one end of the transmission line, the communication unit transmits a signal to the field sensor under the condition that no signal is present on the transmission line during a period of time not shorter than a predetermined time while the field sensor transmits a signal indicative of in-use of the transmission line at an interval of time shorter than the predetermined time during a period of time until the field sensor sends back a signal in response to the signal from the communication unit, whereby signal collision between the plurality of communication units is prevented with no provision of any specific means.

8 Claims, 15 Drawing Sheets

TRANSMITTING SIDE

RECEIVING SIDE

TRANSMITTING SIDE

RECEIVING SIDE

TRANSMITTING SIDE

RECEIVING SIDE

FIELD SENSOR COMMUNICATION METHOD AND SYSTEM

BACKGROUND OF THE INVENTION

The present invention relates to communication with a field sensor, and more particularly to field sensor communication method and system suitable for signal transmission/reception between a plurality of field sensors or communication units In general, a kind of sensor called a field sensor has a variety of sensors incorporated therein and detects physical quantities inclusive of pressures, flow rates, temperatures and/or the like of various plants to convert them into electrical signals which in turn are transmitted to a receiver instrument through a two-wire transmission line This signal transmission is standardized such that the field sensor delivers an analog current signal in a range of 4 to 20 mA and the receiver instrument or a communication unit receives the analog current signal.

On the other hand, in recent years, a field sensor having a microprocessor incorporated therein has been developed and put to practical use owing to improvement in semiconductor integrated circuit technology. In this type of field sensor, one-directional analog signal communication as well as bi-directional digital signal communication are made on a two-wire transmission line so as to allow remote control of range setting, self-diagnosis and/or the like for the field sensor.

FIG. 9 shows an example of a two-wire field sensor system construction which is well known by, for example, U.S. Pat. No. 4,737,787. In the figure, a field sensor 1 outputs an analog signal, serving as a constant current source which supplies a current corresponding to a detected physical quantity to a signal transmission line 5 by virtue of a voltage supplied from an external power source 4, and a receiver instrument 3 receives the analog signal which in turn is used as a value indicative of the physical value of the field sensor 1. A communication unit 2 is connected between the field sensor 1 and the receiver instrument 3 and external power source 4 and communicates with the field sensor 1 by virtue of a digital signal As a method of transmitting a signal to a two-wire transmission line is known by, for example, JP-A-59-201535, a method in which a digital signal is superimposed on an analog signal to communicate the digital signal without giving any influence to the value of the analog signal Also, signal transmission with a change-over between an analog signal and a digital signal is known by JP-A-58-48198.

In the above-mentioned prior art, however, no consideration is paid to the case where a plurality of field sensors or communication units are connected to a signal transmission line. Namely, for example, when a plurality of communication units communicate with one field sensor in an asynchronous manner, there arises a problem that signals collide with each other on a signal transmission line, thereby interrupting a consecutive communication operation. Also, in the case where in a period of time from transmission of a signal from a certain communication unit to a field sensor until return of a response signal for the transmitted signal, that is, in an out-of-use time of a signal line, another communication unit transmits another signal to the same field sensor, a disturbance occurs in the operation of communication between the field sensor and the communication units.

As a method of solving these problems may be considered a method in which signal transmission to a plurality of instruments connected to a common line is made in accordance with a predetermined priority But, there is a problem that this method makes the system complicated in construction and high in cost.

Also, since a field sensor is installed in a plant or the like, a power consumption must be suppressed in view of safety. Accordingly, it is not possible to use a medium size or large size processor and it is necessary to simplify a consecutive communication operation.

SUMMARY OF THE INVENTION

A main object of the present invention is to provide field sensor communication method and system in which communication in the case where a field sensor and a communication unit are connected to a signal transmission line with at least one of the field sensor and the communication unit being plural in number can be made with no need of any specific means between the field sensor and the communication unit and in an asynchronous manner Another object of the present invention is to provide a field sensor and a communication unit suitable for realization of the above-mentioned communication.

A further object of the present invention is to provide a field sensor and a communication unit suitable for realization of such communication.

In a communication system comprising one or a plurality of field sensors for detecting the physical quantity of a process and one or a plurality of communication units for transmitting/receiving a signal to/from the field sensor through a signal transmission line, a main feature of the present invention lies in that upon signal transmission/reception from/by any one of the field sensor and the communication unit to/from the other thereof, a transmitting side transmits a signal to the communication line under the condition that no signal is present on the communication line during a period of time not shorter than a predetermined time while a receiving side transmits a signal indicative of in-use of the transmission line at an interval of time shorter than the predetermined time during a period of time until the receiving side sends back a response signal after having received the signal transmitted from the transmitting side.

The signal indicative of in-use of the transmission line transmitted from the receiving side is an invalid signal which is not used as actual data The object of the present invention can be attained even if the transmission interval of the invalid signal is continual during the period of time until the response signal is sent back.

Another feature of the present invention lies in that in the case where a predetermined response time is required until any one of the field sensors and the communication unit sends back a response signal in response to a signal transmitted from the other of the field sensors and the communication unit, the field sensor or the communication unit transmits a signal under the condition that no signal is present on the signal transmission line during a period of time not shorter than the predetermined response time.

A further feature of the present invention lies in that a field sensor or a communication unit may be connected to a signal transmission line, as required, so as to enable communication with an instrument which is connected to the transmission line. Accordingly, if a field sensor or a communication unit is provided with its function incorporated therein, the field sensor or the communication unit is optionally detachable and communicable.

DESCRIPTION OF THE PREFERRED EMBODIMENTS

An embodiment of the present invention will now be described in reference to FIGS. 1 and 2.

Figure 1:
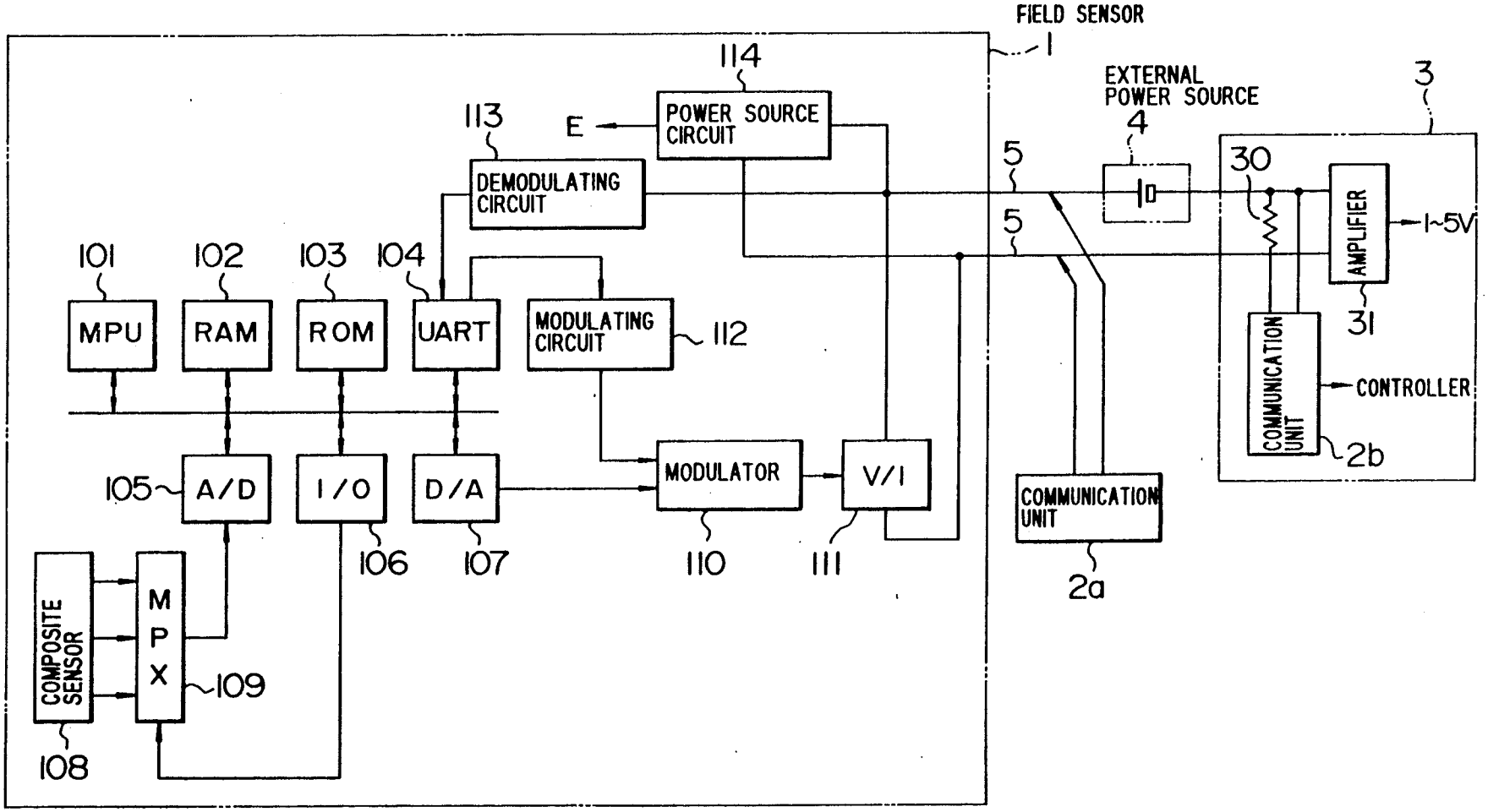
FIG. 1 is a block diagram of the whole of a field sensor communication system according to the present invention.

FIG. 1 shows a block diagram of the whole of a field sensor communication system according to the present invention. In the figure, an output of a field sensor 1 is an analog current signal in a range of 4 to 20 mA and communication is made by virtue of a digital signal which is superimposed on the analog signal. The illustration shows the case where one field sensor is connected to a signal transmission line 5. Though the present embodiment exemplifies the case where one communication unit 2*a* is connected to the signal transmission line 5 and a communication unit 2*b* is incorporated in a receiver instrument 3, a plurality of communication units may be connected. The field sensor 1 operates by virtue of an electric power supplied from an external power source 4 and detects physical quantities such as pressures, flow rates, temperatures or the like at various plants to output signals corresponding to the physical quantities to the signal transmission line 5. The receiver instrument 3 provided with the communication unit 2*b* having the same function as a communication unit which will be mentioned in later, receives the signal from the field sensor 1 corresponding to the physical quantity and communicates with the field sensor 1 to perform a processing such as self-diagnosis, range setting and/or the like for the field sensor 1. The communication unit 2*a* is connected between the field sensor 1 and the receiver instrument 3 and external power source 4 on the signal transmission line 5 and communicates with the field sensor 1 by virtue of a digital signal to perform a processing such as output adjustment, input/output signal monitoring, calibration and/or the like for the field sensor 1.

Next, particular operations of respective devices in FIG. 1 will be explained. In the field sensor 1, the whole of the sensor is controlled by a microprocessor 101 through a processing based on information programmed in a ROM 103. A composite sensor 108 includes a plurality of sensors which are composed of, for example, a differential pressure sensor, a flow rate sensor, a temperature and/or the like. Output signals of the respective sensors are brought to a multiplexer 109 in which a sensor signal to be sent to an A/D converter 105 is selected by an input change-over signal from an I/0 interface 106. The microprocessor 101 compares signals successively sent from the A/D converter 105 with various correction factors stored in the ROM 103 or a RAM 102 to perform an operation for correction and thereby to determine a true value and delivers to a D/A converter 107 and output value normalized by an output range which is preliminarily set in the RAM 102. Also, the microprocessor 101 can set a monitoring time for a reception signal on the signal transmission line 5 and can arbitrarily set the transmission interval and the transmission time of an invalid signal which is outputted from a transmitter/receiver circuit (UART) 104 and indicates in-use of the signal transmission line 5, as will be mentioned in later.

An output value of the D/A converter 107 is modulated with a digital output signal of a modulating circuit 112 in a modulator 110 and is sent to a V/I converter 111. In the V/I converter 111, a control is made such that a current (usually, in a range of 4 to 20 mA) corresponding to a signal inputted thereto is flown through the signal transmission line 5.

In the case of making communication of a digital signal, transmission data and the invalid signal which are outputted from the transmitter/receiver circuit (UART) 104 and the latter of which indicates in-use of the signal transmission line 5, are modulated by the modulating circuit 112 into, for example, two kinds of frequency signals corresponding to "1" and "0" of a digital signal, as in frequency modulation. This signal is modulated with (or added to) the analog signal output value in the modulator, as mentioned above, and the digital signal superimposed on the analog signal is transmitted through the V/I converter 111 to the signal transmission line 5. So long as an output signal of the modulating circuit 112 is a square wave or sine wave signal having the same amplitude in positive and negative directions, the analog signal value is not almost affected with only an instantaneous change of the output current value of the V/I converter 111 even if a digital signal is outputted from the modulating circuit 112.

In the case of receiving a digital signal, signals transmitted from the communication unit 2*a* and the receiver instrument 3 are digital signals similar to the modulated current signal as mentioned above. A voltage value of the external power source 4 which supplies a voltage to the signal transmission line 5 is always constant, and a change of the value of a current flowing through the signal transmission line 5 causes a corresponding change of a voltage developed across a resistor 30 for analog signal detection in the receiver instrument 3. Therefore, a voltage applied to the field sensor 1 necessarily has a change which is the reverse to the above-mentioned voltage change. In a demodulating circuit 113, this voltage change is detected and demodulated into a digital signal of "1" and "0". This digital signal can be received by the transmitter/receiver circuit (UART)

104. Also in the case where the field sensor 1 transmits a digital signal, the signal transmitted from the field sensor 1 itself can be received through the demodulating circuit 113 since the value of a current flowing through the signal transmission line 5 changes.

The monitoring of a reception signal on the signal transmission line 5 is made in such a manner that the microprocessor 101 judges whether a signal received through the demodulating circuit 113 and the transmitter/receiver circuit 104 is an invalid signal or a valid signal.

Next, explanation will be made of the operation of the receiver instrument 3. The resistor 30 connected in series with the signal transmission line 5 usually has a resistance value of 250 Ω and a voltage across the resistor is taken out by an amplifier 31 so that an analog current signal (4 to 20 mA) flowing through the signal transmission line 5 is converted into a voltage of 1 to 5 V and is transmitted to a host system such as a large size computer. The communication unit 2*b* is constructed by the same circuits as the microprocessor, transmitter/-receiver circuit, and modulating and demodulating circuits included in the field sensor 1. The communication unit 2*b* transmits a digital signal by supplying a current signal to the signal transmission line 5 and receives a digital signal by virtue of a change of a voltage across the resistor 30. Also in the receiver instrument 3, a signal transmitted from the receiver instrument 3 itself can be received in a manner similar to that mentioned above.

The communication unit 2*a*, too, is constructed by the same circuits as the microprocessor, transmitter/-receiver circuit, and modulating and demodulating circuits included in the field sensor 1. The communication unit 2*a* transmits a digital signal by supplying a current signal to the signal transmission line 5 and receives a digital signal by virtue of a change of a voltage between wires of the signal transmission line 5. Also in the communication unit 2*a*, a signal transmitted from the communication unit 2*a* itself can be received in a manner similar to that mentioned above.

Figure 2:
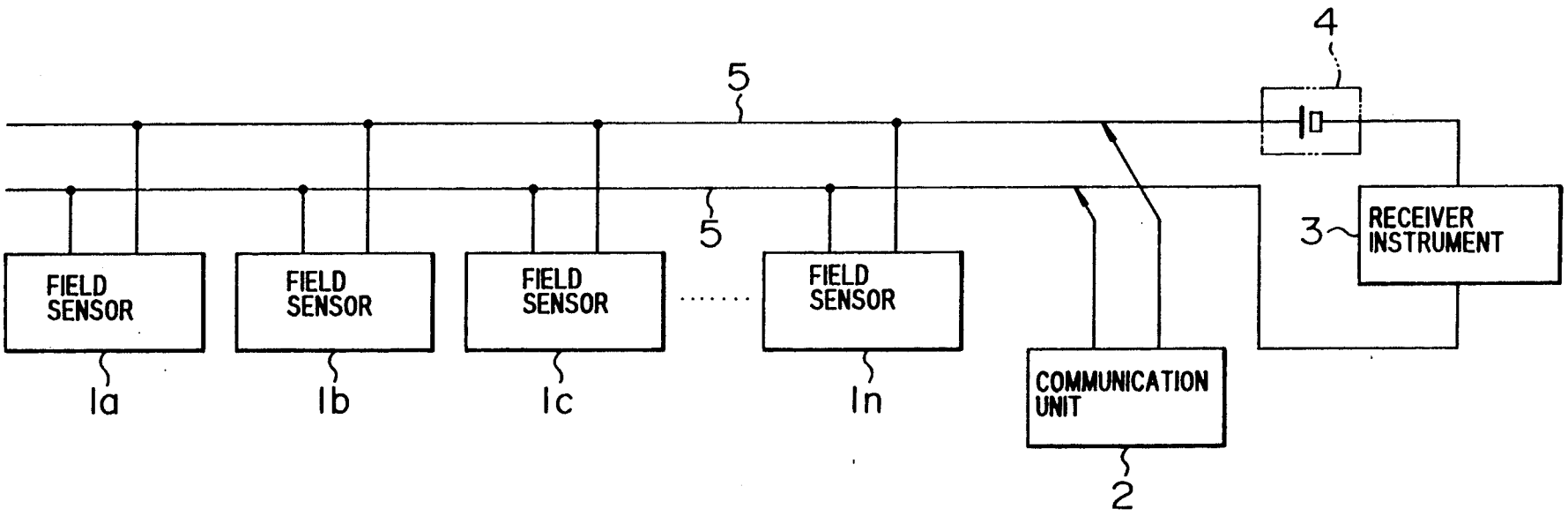
FIG. 2 is a block diagram according to the present invention in the case where a multiplicity of field sensors are connected to a signal transmission line.

FIG. 2 is a block daigram according to the present invention in the case where a multiplicity of field sensors 1*a* to 1*n* are connected to a signal transmission line 5. In the figure, an output of each of the field sensors 1*a* to 1*n* is a digital signal. The signal output can be provided by bringing an analog signal output of the D/A converter 107 in the field sensor 1 shown in FIG. 1 to zero. Since the operations of the field sensors 1*a* to 1*n*, a communication unit 2 and a receiver instrument 3 are quite the same as the case of FIG. 1, explanation will be omitted.

Though FIG. 2 shows an example in which one communication unit 2 is connected to the signal transmission line 5, a plurality of communication units may be connected.

Next, signal transmitting/receiving operations in the system construction of FIG. 1 or 2 will be explained by use of flow charts and time charts shown in FIGS. 3 to 8.

Figure 3A:
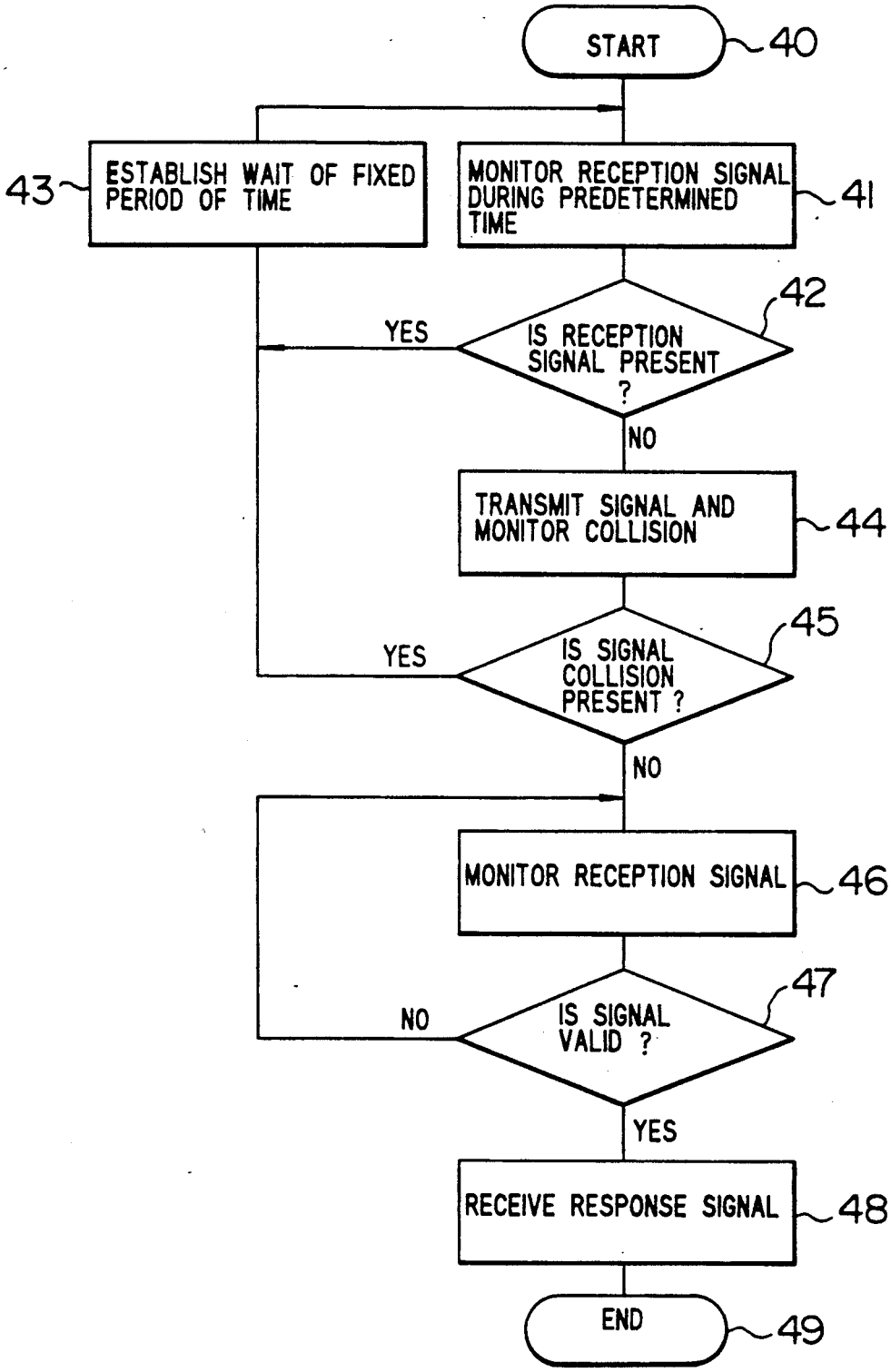
FIGS. 3(*a*) and 3(*b*) are an example of a flow charts of the present invention in the case where a receiving side transmits an invalid signal having an interval of time shorter than a predetermined time.
Figure 3B:
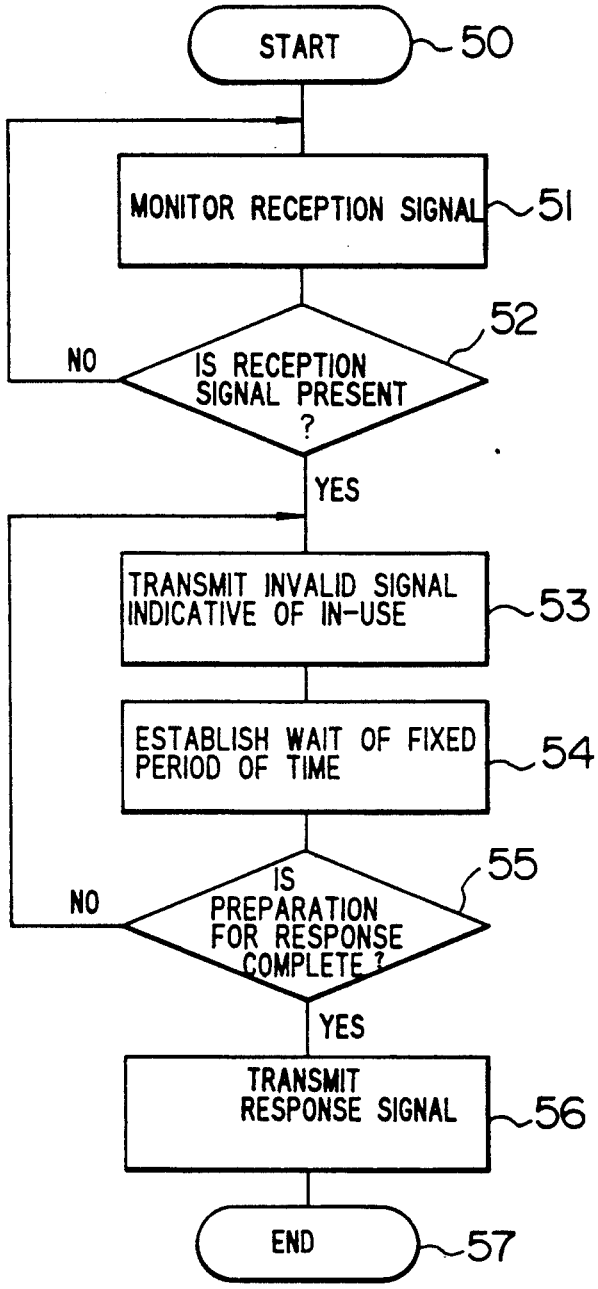

FIGS. 3(*a*), 3(*b*), 4(*a*), 4(*b*) and 4(*c*) are flow charts and time charts of a communication operation in the case where a receiving side transmits an invalid signal at an interval of time shorter than a predetermined time until it sends back a response signal.

FIG. 3(*a*) is a flow chart of the communication operation of a transmitting side. Prior to starting transmission, the transmitting side monitors a reception signal on a signal transmission line during a period of time until a receiving side sends back a response signal after having received a signal from the transmitting side, that is, a predetermined time (step 41). In the case where a reception signal is present, a wait of a fixed time is established (step 43) and therefter the monitoring of a reception signal is made again until the reception signal disappears (step 41). Confirming that no reception signal is present and hence the signal transmission line is not in use, the transmitting side transmits a signal and at the same time it receives the signal transmitted from itself to monitor signal collision (step 44). Further, the monitoring of a reception signal is continued. And, in the case where an invalid signal is present, the monitoring of a reception signal is performed again (step 46) until a response signal from the receiving side is received (step 48). In the case where the transmitted signals encounter collision, the collision certainly begins from the first transmitted signal. Therefore, it is not necessary that the collision monitoring for transmitted signals is made for all the transmitted signals. Accordingly, there may be employed a method in which the collision monitoring is performed for only the first transmitted signal and signals transmitted after having confirming the absence of collision are not subjected to collision monitoring.

FIG. 3(*b*) shows a flow chart of the communication operation of the receiving side. The receiving side monitors a signal transmitted toward the receiving side itself (step 51). In the case where a reception signal is not present, the monitoring of a reception signal is performed again (step 51). In the case where a reception signal is present, an invalid signal, which indicates in-use of the signal transmission line and may be, for example, SYN of control code not used as actual data, is transmitted during a period of time until the sending-back of a response signal and at an interval of time shorter than the monitoring time for the reception signal at the transmitting side (step 53). The receiving side transmits the response signal at a stage when it has been ready for response (step 56).

Figure 4A:
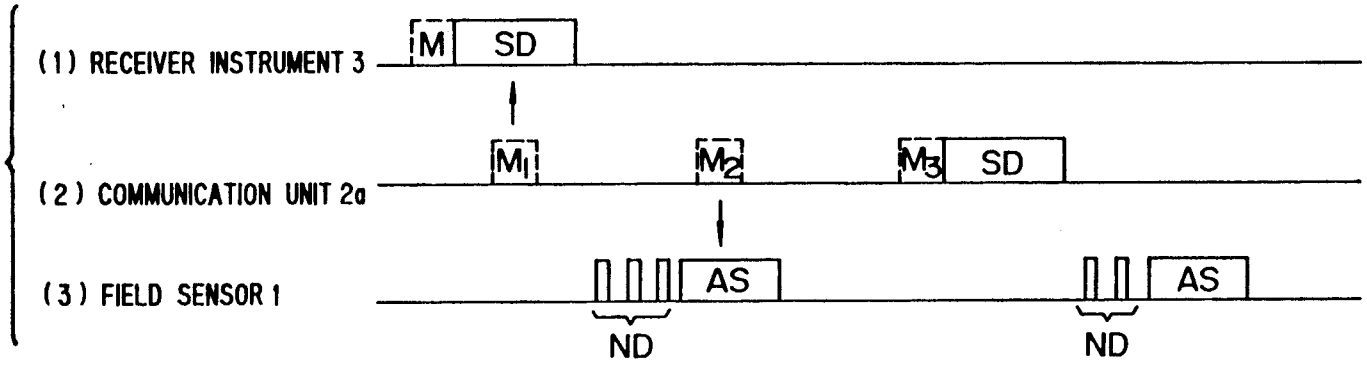
FIGS. 4(*a*), 4(*b*) and 4(*c*) are time charts of FIGS. 3(*a*) and 3(*b*)
Figure 4B:
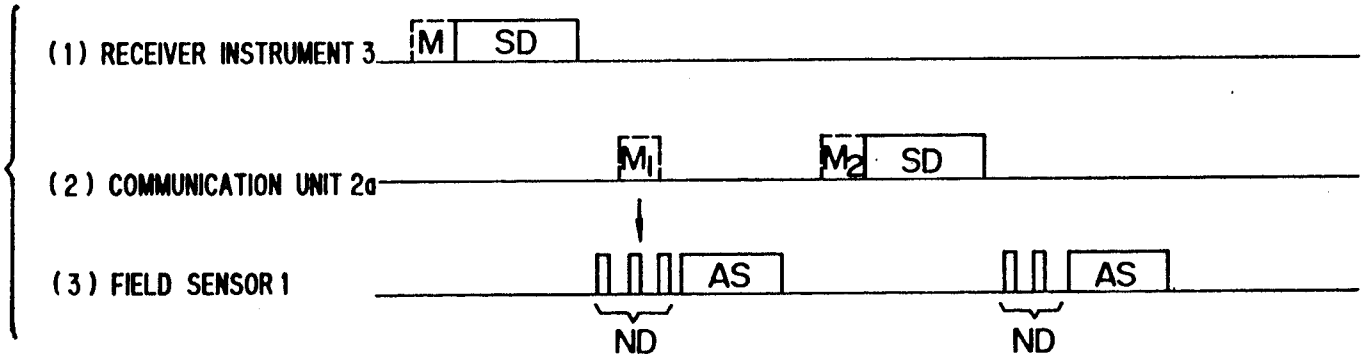

FIGS. 4(*a*), 4(*b*) and 4(*c*) are time charts showing a communication operation in the case where the receiver instrument 3 and the communication unit 2*a* are brought into transmitting/receiving conditions and the field sensor 1 is a receiving side.

FIG. 4(*a*) is an example of the case where the communication unit 2*a* starts transmission during a time when the receiver instrument 3 is transmitting a transmission signal SD. The communication unit 2*a* first confirms the absence of a reception signal or out-of-use of the signal transmission line in the third reception signal monitoring period of time $T_3$ and then transmits a transmission signal SD.

FIG. 4(*b*) is an example in which the communication unit 2*a* starts transmission in a period of time after the field sensor 1 has received a signal and until the field sensor 1 sends back a response signal AS for the received signal The field sensor 1 transmits an invalid signal ND indicative of in-use of the signal transmission line at an interval of time shorter than the time width of a monitoring period of time $M_1$ and the invalid signal is confirmed in the monitoring period of time $M_1$. Accordingly, actual transmission/reception of a transmission signal SD by the communication unit 2*a* is made after a consecutive communication operation between the receiver instrument 3 and the field sensor 1 has been completed. Thus, there is not a fear that the communication unit 2a interrupts the consecutive communication operation to transmit a signal.

Figure 4C:
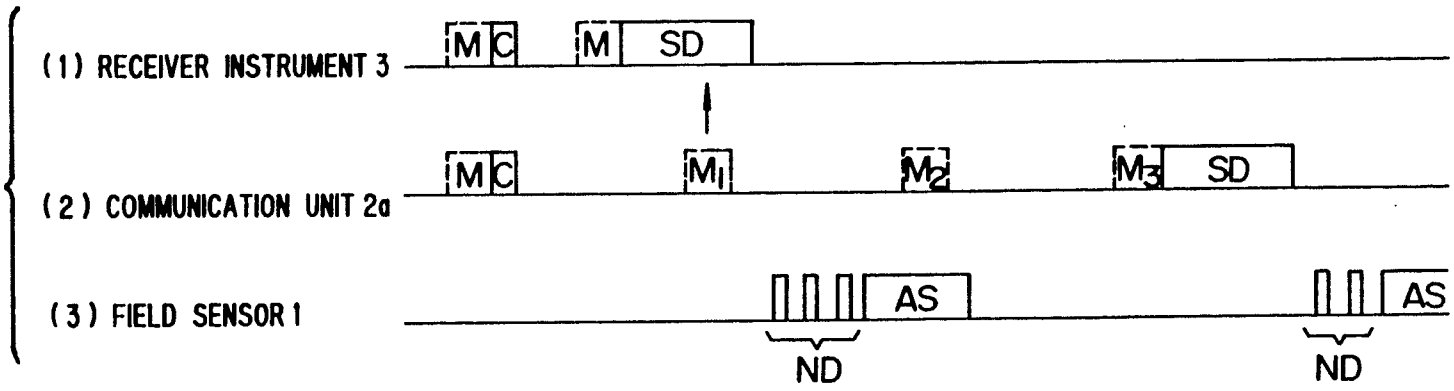

FIG. 4(c) is an example in which the receiver instrument 3 and the communication unit 2a on the transmitting side start transmission at the same time. When the receiver instrument 3 and the communication unit 2a transmit transmission signals C at the same time, the signals collide with each other and the collision is detected by both the receiver instrument 3 and the communication unit 2a which in turn perform processings for re-transmission of the transmission signals. If a wait time until completion of the transmission signal re-transmission processing is set to be different between the receiver instrument and the communication unit, it is possible to prevent signal collision from occurring again upon re-transmission. In FIG. 4(c) is shown an example in which after both the receiver instrument 3 and the communication unit 2a have confirmed the signal collision, the communication unit 2a monitors again a reception signal after a wait of a fixed time to perform a signal re-transmission processing. Since the signal collision occurs between initial data of the transmission, as shown in the figure, no valid data is transmitted to the field sensor 1 and hence there is not a fear that the field sensor 1 makes an erroneous operation due to the collision of transmission signals at the transmitting side.

According to the present embodiment, the receiving side can ensure a priority for the signal transmission line in such a manner that an out-of-use time of the signal transmission line until the receiving side sends back a response signal after having received a signal is occupied by an invalid signal transmitted from the receiving side. Accordingly, since another device judges that the signal transmission line is in use until a consecutive communication operation from start of transmission of a signal by the transmitting side to sending-back of a response by the receiving side is finished, it is possible to make the consecutive communication operation complete in the shortest time with no fear that the consecutive communication operation is discontinued due to an interruption from the other device.

Also, the receiving side has no need of continuous monitoring of a signal on the signal transmission line or can make communication by virtue of only a simple operation which requires to perform only the extraction of a valid signal and to send back a response for the valid signal.

Next, another embodiment of a transmitting side and a receiving side concerning a communication according to the present invention will be shown in FIGS. 5 to 8.

FIGS. 5(a), 5(b), 6(a), 6(b) and 6(c) are flow charts and time charts of a communication operation in the case where a receiving side transmits an invalid signal continually.

Figure 5A:
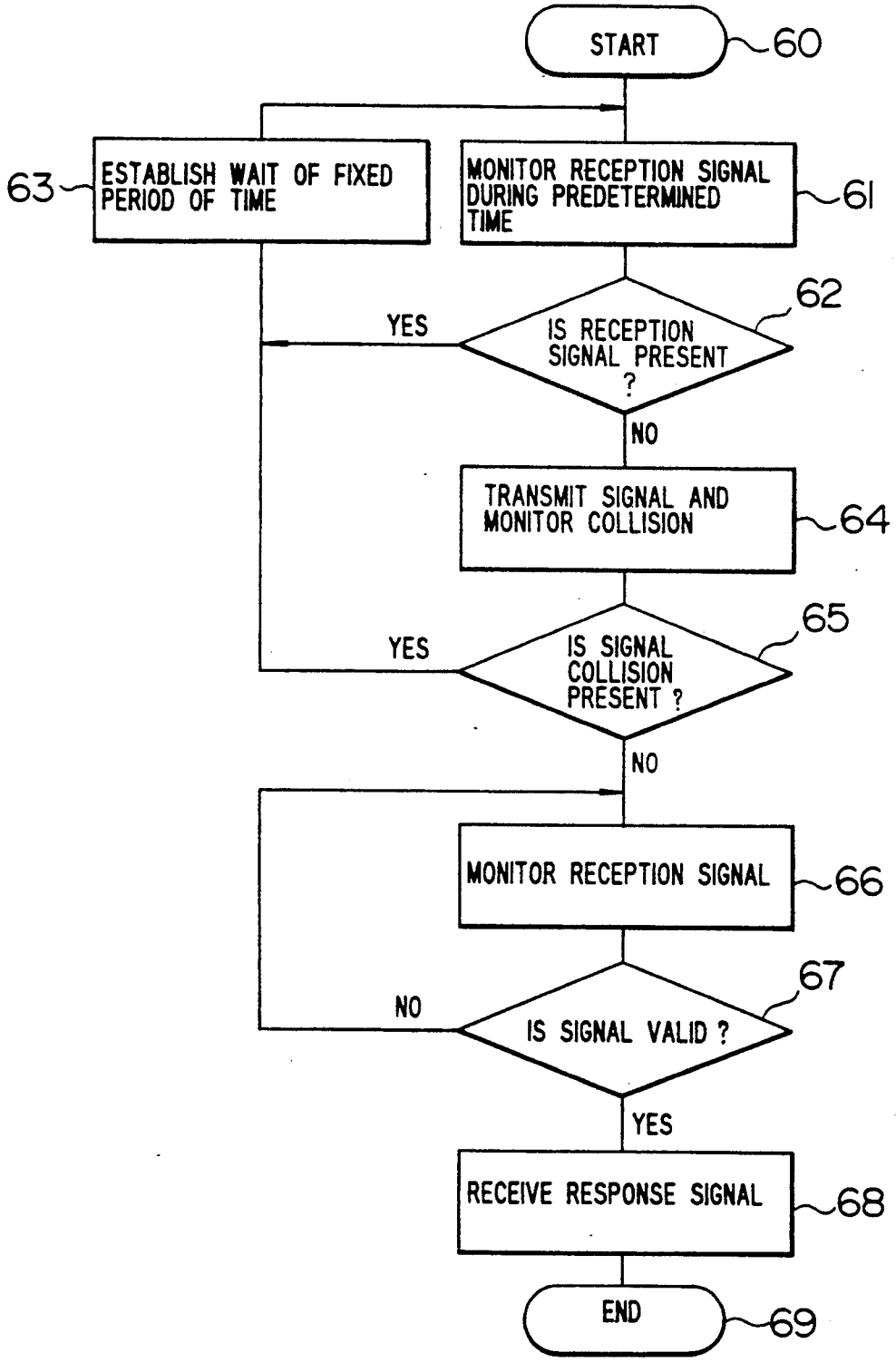
FIGS. 5(*a*) and 5(*b*) are flow charts in the case where a receiving side transmits an invalid signal continually.

FIG. 5(a) shows a flow chart of the communication operation of a transmitting side. In the figure, prior to starting transmission, the transmitting side monitors a reception signal during a predetermined time (step 61). In the case where a reception signal is present, a wait of a fixed time is established (step 63) and thereafter the monitoring of a reception signal is made again until the reception signal disappears (step 61). Confirming that no reception signal is present and hence the signal transmission line is not in use, the transmitting side transmits a signal and the same time it receives the signal transmitted from itself to monitor signal collision (step 64). In the case where there is no collision, the transmitting side receives an invalid signal continually transmitted from a receiving side and a response signal transmitted therefrom subsequently to the invalid signal (step 68).

Figure 5B:
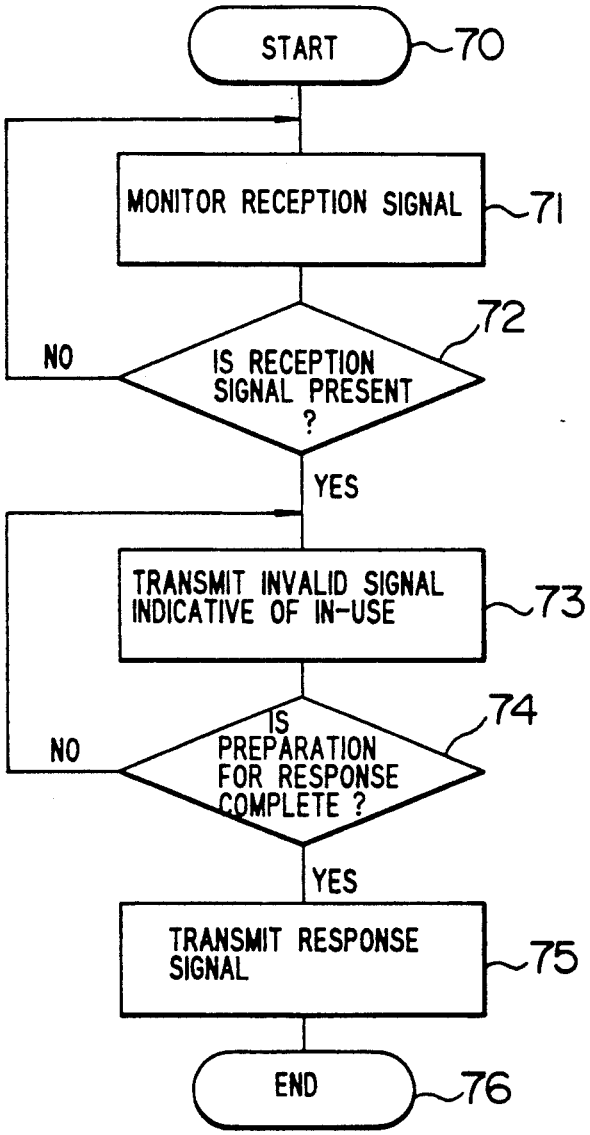

FIG. 5(b) is a time chart of the communication operation of the receiving side. The receiving side monitors a signal transmitted toward the receiving side itself (step 71). In the case where a reception signal is not present, the monitoring of a reception signal is performed again (step 71). In the case where a reception signal is present, the receiving side continually transmits an invalid signal ND indicative of in-use of the transmission line during a period of time until it transmits a response signal for the received signal (step 73). When a preparation for response is not complete, the invalid signal ND is transmitted continually until the preparation has been completed (step 73). After the preparation for response has been completed, the response signal is transmitted (step 75).

Figure 6A:
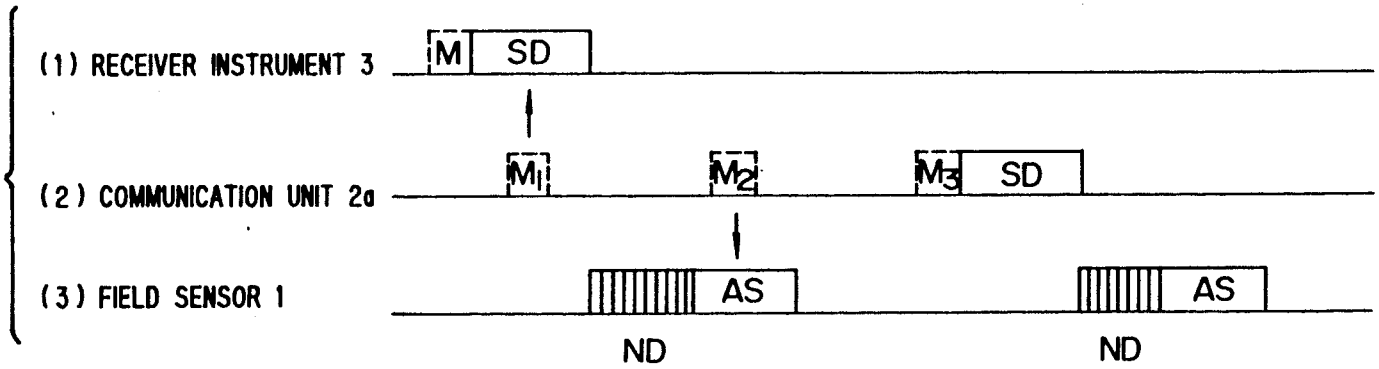
FIGS. 6(*a*), 6(*b*) and 6(*c*) are time charts of FIGS. 5(*a*) and 5(*b*)

FIG. 6(a) is an example in which the communication unit 2a starts transmission during a time when the receiver instrument 3 is transmitting a transmission signal SD. The communication unit 2a confirms the absence of a reception signal in the third monitoring period of time $M_3$ and subsequently transmits a transmission signal SD.

Figure 6B:
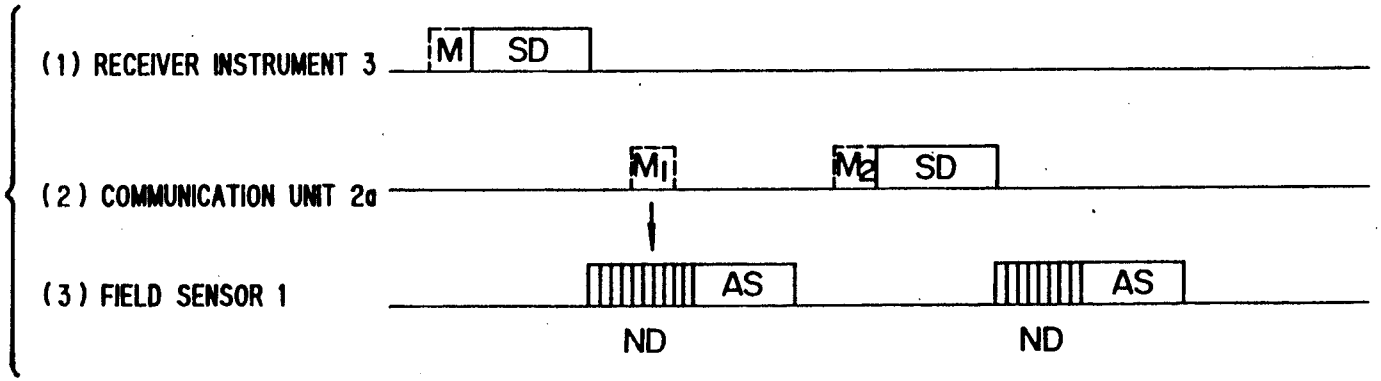

FIG. 6(b) is an example in which the communication unit 2a starts transmission during a time when the field sensor 1 is transmitting an invalid signal ND continually until sending-back of a response. The communication unit 2a confirms in-use of the transmission line by the invalid signal which is transmitted continually in the first monitoring period of time $M_1$.

Figure 6C:
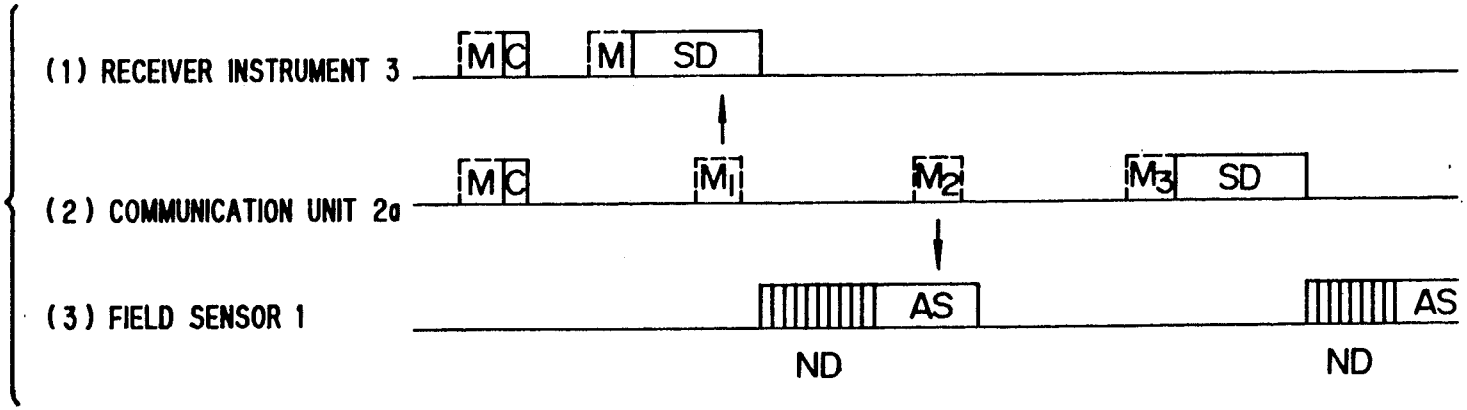

FIG. 6(c) is an example in which the receiver instrument 3 and the communication unit 2a start transmission at the same time. Like the case of FIG. 4(c), though transmission signals C of the receiver instrument 3 and the communication unit 2a collide with each other, the monitoring of a reception signal is performed again and a transmission signal SD is transmitted after the absence of signal collision has been confirmed.

According to the present embodiment, since the continual transmission of the invalid signal by the receiving side is easy, the system can be simplified, thereby making highly reliable communication possible. Further, since an out-of-use time of the signal transmission line is occupied by the continual invalid signal, there are obtained effects similar to that in the above-mentioned case where the invalid signal is transmitted at a short interval of time, for example, an effect that any signal interruption from another device is excluded.

FIGS. 7(a), 7(b), 8(a), 8(b) and 8(c) are flow charts and time charts of a communication operation in the case where a reception signal monitoring time of a transmitting side is longer than a response time of a receiving side.

Figure 7A:
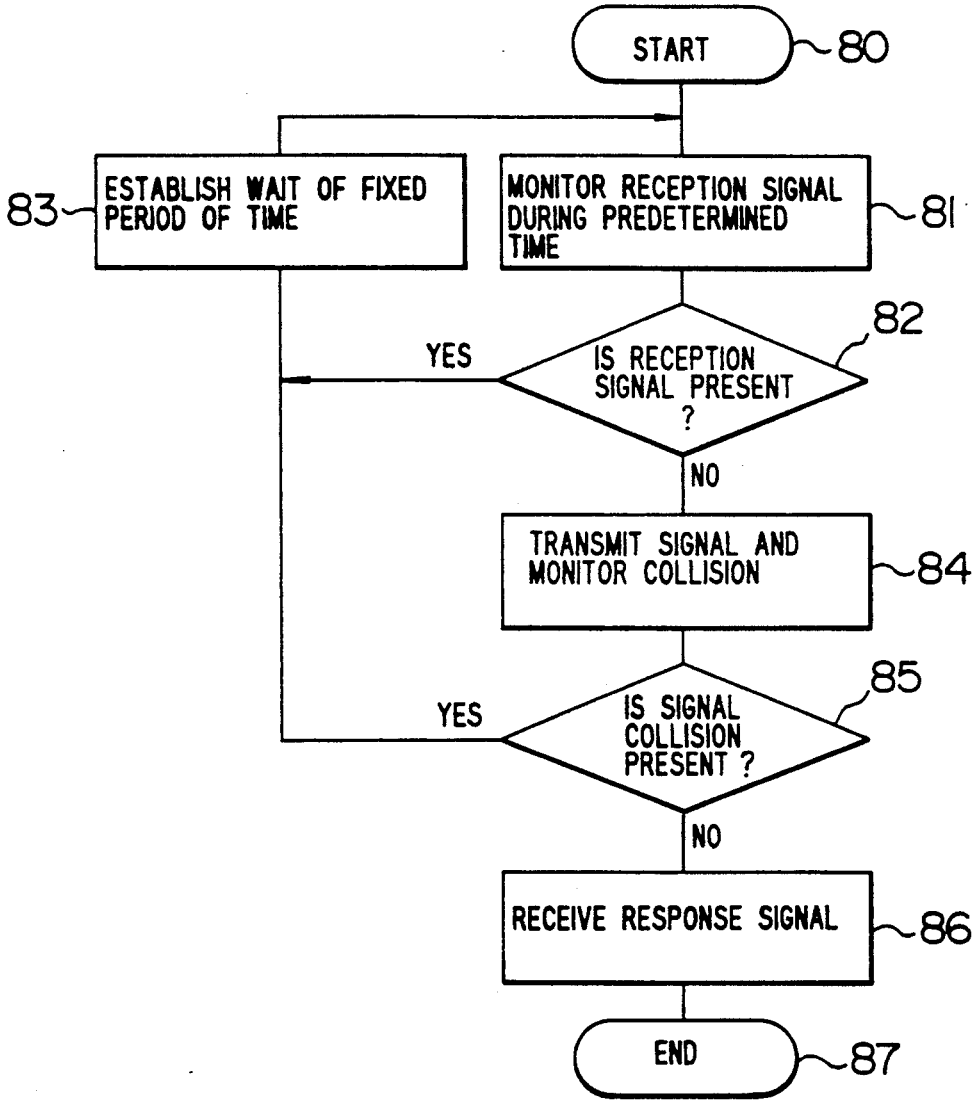
FIGS. 7(*a*) and 7(*b*) are flow charts in the case where a reception signal monitoring time of a transmitting side is longer than a response time of a receiving side.
Figure 7B:
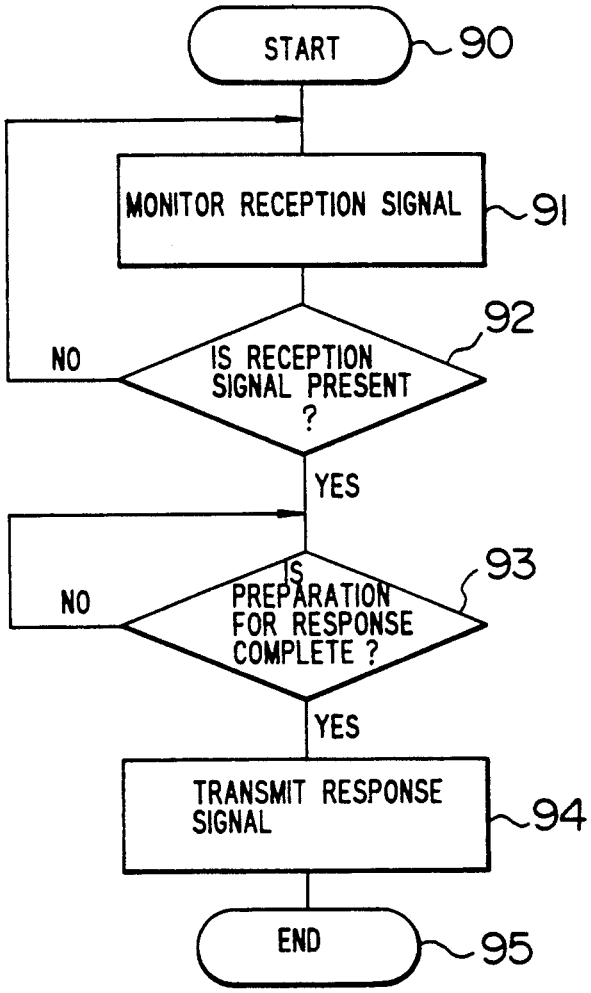
Figure 8A:
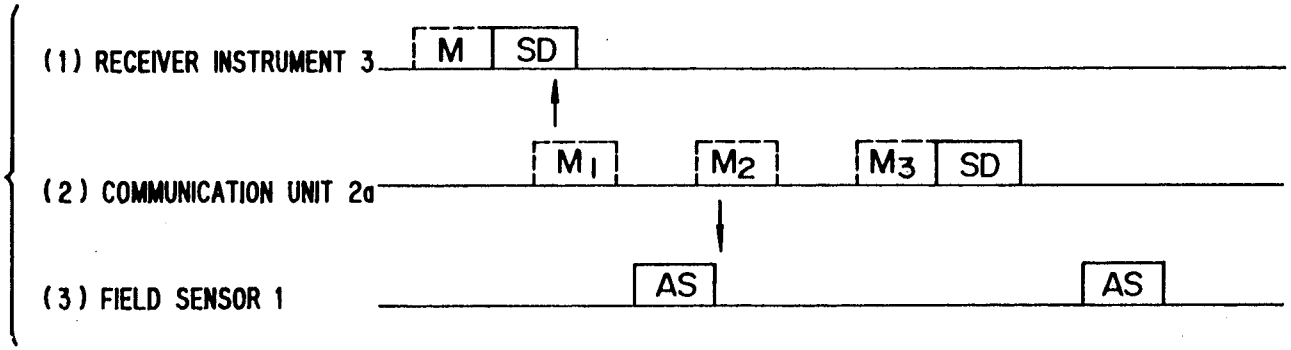
FIGS. 8(*a*), 8(*b*) and 8(*c*) are time charts of FIGS. 7(*a*) and 7(*b*)
Figure 8B:
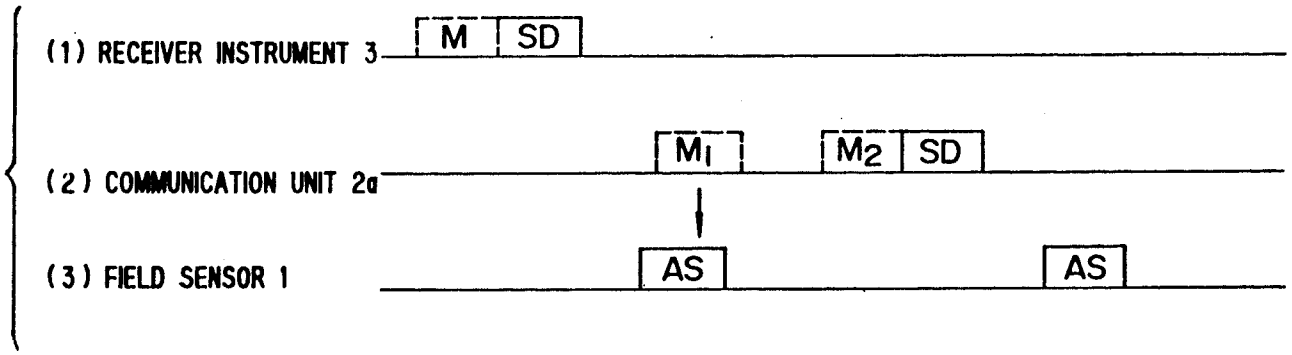
Figure 8C:
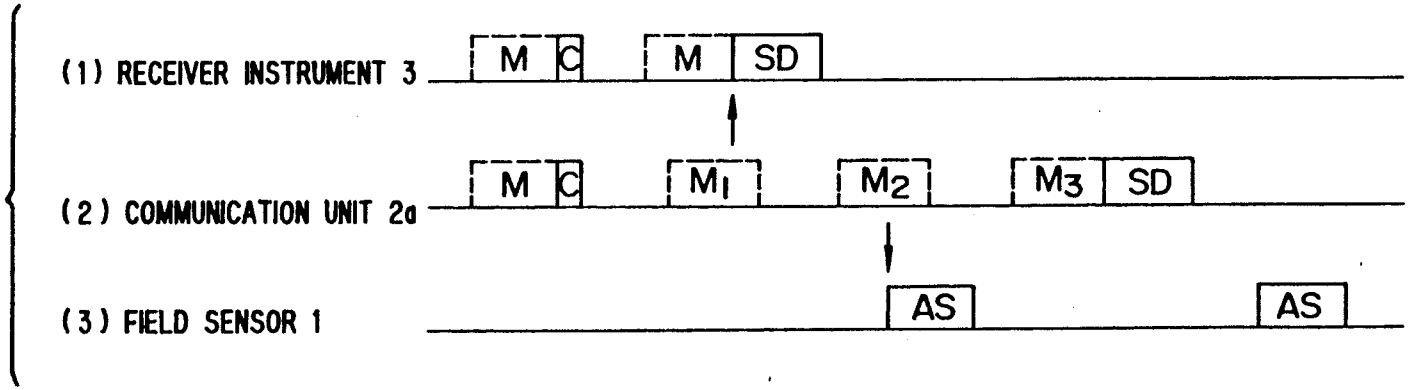
Figure 9:
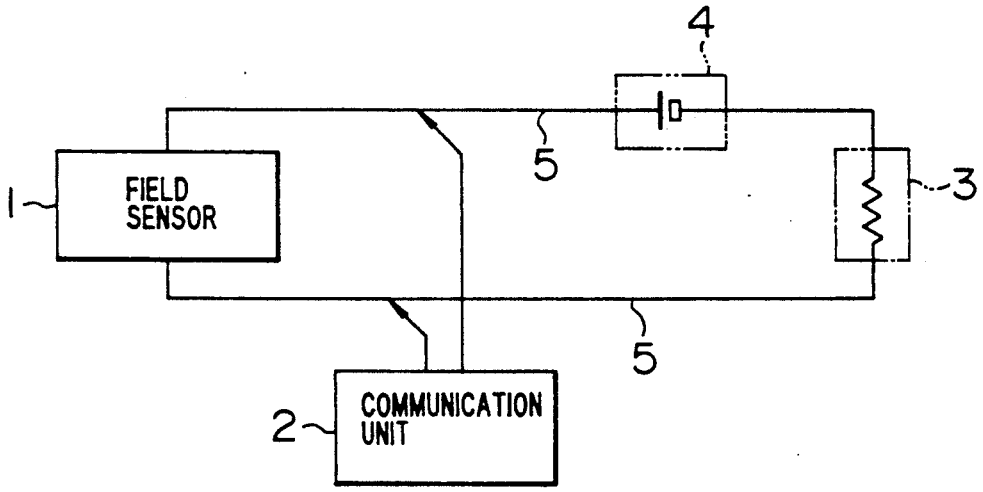
FIG. 9 PRIOR ART
FIG. 9 is a block diagram of the conventional two-wire field sensor communication system.

FIG. 7(a) is a flow chart of the transmitting side. Prior to starting transmission, the transmitting side monitors a reception signal during a period of time longer than the response time of the receiving side (step 81). Confirming a reception signal is not present and hence the signal transmission line is not in use, the transmitting side transmits a signal and at the same time receives the signal transmitted from itself to monitor signal collision (step 84). If there is no collision, the transmitting side receives a response signal transmitted from the receiving side (step 86). FIG. 7(b) is a flow chart of the receiving side. The receiving side monitors a signal transmitted toward itself (step 91). After a wait for the completion of a preparation for transmission of a response signal (step 93), the receiving side transmits the response signal (step 94).

FIG. 8(*a*) is an example in which the communication unit 2*a* starts transmission during a time when the receiving instrument 3 is transmitting a transmission signal SD. FIG. 8(*b*) is an example in which the communication units 2*a* starts transmission during a time when the field sensor 1 is sending back a response. In either case, consecutive communication between the receiver instrument 3 and the field sensor 1 is performed with no interruption by the communication unit 2*a*. FIG. 8(*c*) is an example in which the receiver instrument 3 and the communication unit start their communication operations at the same time. Like the case of FIG. 4(*c*), though signal collision occurs, communication with no re-occurrence of collision is made through a re-transmission processing.

According to the present embodiment, since the issuance of an invalid signal from the receiving side is not required, an invalid signal generating device is not needed. Therefore, the system becomes simple and low in cost.

As has been explained in the foregoing, according to the present invention, in the case where a plurality of field sensors or communication units are connected to a signal transmission line, signal collision on the signal transmission line can be prevented with no need of specific means for establishing the priority of communication, thereby making it possible to simply perform communication. Accordingly, the large-size requirement of a processor constructing the field sensor or the communication unit can be mitigated, thereby making it possible to realize very practical field sensor communication.

We claim:

1. A field sensor communication method for a communication system comprising a field sensor for detecting a physical quantity of a process and a communication unit, either said field sensor or said communication unit transmitting or receiving a transmission signal through a signal transmission line, the method comprising the steps of:

transmitting a first signal from a transmitting side of either said field sensor or said communication unit to said signal transmission line after detecting an absence of said transmission signal on said signal transmission line during a first period of time which is not shorter than a predetermined time period; and transmitting a second signal from a receiving side of the other of either said field sensor or said communication unit indicative of in-use of said signal transmission line at an interval of time which is shorter than said predetermined time period, said second signal being transmitted during a second period of time after the first period of time until the receiving side transmits a response signal after having received the first signal transmitted from the transmitting side.

2. A field sensor communication method according to claim 1, wherein the method further includes the steps of detecting an absence of a collision of said transmission signal transmitted from either said field sensor or said communication unit during the first period of time and transmitting the first signal after said first period of time if the collision was not detected.

3. A field sensor communication method for a communication system comprising a field sensor for detecting a physical quantity of a process and a communication unit, either said field sensor or said communication unit transmitting or receiving a transmission signal through a signal transmission line, said method comprising the steps of:

monitoring and detecting the presence or absence of said transmission signal by a transmission side of either said field sensor or said communication unit on said signal transmission line to prevent the transmission of a first signal by said transmission side when said transmission signal is present on said signal transmission line during a monitoring time period;

waiting a predetermined waiting period if said transmission signal is detected and then monitoring and detecting the presence or absence of said transmission signal by the transmission side of either said field sensor or said communication unit on said signal transmission line to prevent the transmission of the first signal by said transmission side for said monitoring time period;

transmitting the first signal after the monitoring time period if said transmission signal is not detected; and transmitting an invalid signal by a receiving side of the other of either said field sensor or said communication unit at an interval of a first time period after the monitoring time period, the interval being shorter than said monitoring time period, said first time period ending when the receiving side transmits a response signal after having receiving said first signal from the transmitting side.

4. A field sensor communication method according to claim 3, wherein said invalid signal is transmitted continually during the first period of time until the response signal is transmitted by said receiving side.

5. A field sensor communication method according to claim 3, wherein the method further includes the steps of detecting an absence of a collision of said transmission signal transmitted from either said field sensor or said communication unit during the monitoring time period and transmitting the first signal after said monitoring time period if said collision was not detected.

6. A field sensor communication method for a communication system comprising an industrial instrument and a communication unit, said industrial instrument transmitting to or receiving from said communication unit a transmission signal through a signal transmission line, said method comprising the steps of:

transmitting a first signal from said communication unit to said signal transmission line after detecting an absence of said transmission signal on said signal transmission line during a first period of time which is not shorter than a predetermined time period; and transmitting an invalid signal from said industrial instrument at an interval of time shorter than said predetermined time period, said invalid signal being transmitted during a second period of time between when said first signal is received by said industrial instrument and until said industrial instrument transmits a response signal to said signal transmission line after having received the first signal transmitted from said communication unit.

7. A field sensor communication method according to claim 6, wherein said invalid signal is transmitted continually during the second period of time until the response signal is transmitted by said industrial instrument.

8. A field sensor communication system comprising a field sensor for detecting a physical quantity of a process and a communication unit, either said field sensor or communication unit transmitting or receiving a transmission signal through a signal transmission line, either said field sensor or said communication unit including a transmitting side including means for detecting an absence of said transmission signal on said signal transmission line during a first period of time which is not shorter than a predetermined time period and to transmit a first signal after said first period of time, and the other of either said field sensor or said communication unit including a receiving side including means for transmitting a second signal indicative of in-use of said signal transmission line during an interval of time shorter than said predetermined time period after said first signal is received by said receiving side and until a response signal is transmitted by said receiving side.

* * * * *